United States Patent [19]

Mendoza

[11] Patent Number: 4,556,933

[45] Date of Patent: Dec. 3, 1985

[54] UNDERWATER LIGHT ASSEMBLY WITH ANNULARLY FLARED RE-ENTRANT WALL AND SEALING MEANS

[75] Inventor: Joe Mendoza, Garden Grove, Calif.

[73] Assignee: Purex Pool Products, Inc., Lakewood, Calif.

[21] Appl. No.: 644,507

[22] Filed: Aug. 27, 1984

[51] Int. Cl.[4] ..... F21V 29/00

[52] U.S. Cl. ..... 362/267; 362/318; 362/365; 362/294; 362/390

[58] Field of Search ..... 362/267, 294, 318, 365, 362/390

[56] References Cited

U.S. PATENT DOCUMENTS

| | | | |
|---|---|---|---|
| 3,840,735 | 10/1974 | Chan | 362/267 |
| 3,914,592 | 10/1975 | Maxey | 240/26 |
| 4,234,819 | 11/1980 | Maxey | 315/119 |
| 4,410,931 | 10/1983 | DeCandia et al. | 362/267 |
| 4,433,366 | 2/1984 | Wade | 362/267 |
| 4,460,944 | 7/1984 | Gordbegli et al. | 362/276 |

OTHER PUBLICATIONS

Purex Publication "Parts Replacement Guide".

*Primary Examiner*—Peter A. Nelson
*Attorney, Agent, or Firm*—William W. Haefliger

[57] ABSTRACT

In an underwater pool or spa light assembly for retaining an annular lens gasket and light housing in position, comprises:

(a) a face ring having a central axis and annular re-entrant wall defining an annular flared portion to seat the gasket assembly, the ring also having retainer structure to retain said light housing which is engageable with the gasket to annularly compress same axially, (b) and circularly spaced tabs on the ring and projecting generally axially beyond the edge of the annularly flared portion to peripherally position the gasket, blocking radially outward extrusion thereof when compressed by the housing.

8 Claims, 6 Drawing Figures

UNDERWATER LIGHT ASSEMBLY WITH ANNULARLY FLARED RE-ENTRANT WALL AND SEALING MEANS

BACKGROUND OF THE INVENTION

This invention relates generally to underwater light structures, and more particularly to means for supporting and sealing off between lens, gasket and light housing elements of such structures.

There is a continual need for reliable, simple, and low cost underwater light assemblies usable for example in pool or spa walls, and having long life characteristics. For this purpose, the reliability of seals formed between gaskets, lenses and light housing elements is critical. To this end, face rings have been employed to carry such gaskets; however, they lacked the highly and unusually advantageous construction and modes of operation and other advantageous features of the face ring and associated structure of the present invention.

SUMMARY OF THE INVENTION

It is a major object of the invention to provide an assembly that overcomes problems and disadvantages of prior underwater light devices, and which is embodied in the assembly construction as will appear. Basically, the pool or spa light assembly is adapted for retaining an easily assembled annular lens gasket and light housing in fixed and confined sealed off position, and comprises:

(a) a face ring having a central axis and re-entrant wall defining an annular flared portion to seat the gasket annularly, the ring also having means thereon to retain said light housing which is engagable with the gasket to annularly compress same, axially, (b) and circularly spaced tabs on the ring and projecting generally axially beyond the edge of said annularly flared portion to peripherally position the gasket, blocking radially outward extrusion thereof when compressed by said housing.

As will appear, the tabs and ring typically define a one-piece unit, the tabs carried by the re-entrant wall annular flared portion; the gasket has its periphery positioned radially inwardly of the tabs and is axially compressed or confined between the flared wall and an annular flange defined by the housing to seal off therebetween when the gasket presses against the confining tabs; and the lens has an annular peripheral flange confined by a U-shaped cross section portion of the gasket.

Further, means on the face ring urges the light housing flange against the gasket to press it against the tabs, as described; and such means advantageously comprises studs attached to the face ring and projecting closely adjacent a circle defined by the tabs; there being fasteners adjustably received by the studs and adjustably urging the light housing flange against the gasket to develop required sealing pressure.

These and other objects and advantages of the invention, as well as the details of an illustrative embodiment, will be more fully understood from the following specification and drawings, in which:

DRAWING DESCRIPTION

DETAILED DESCRIPTION

Figure 1:
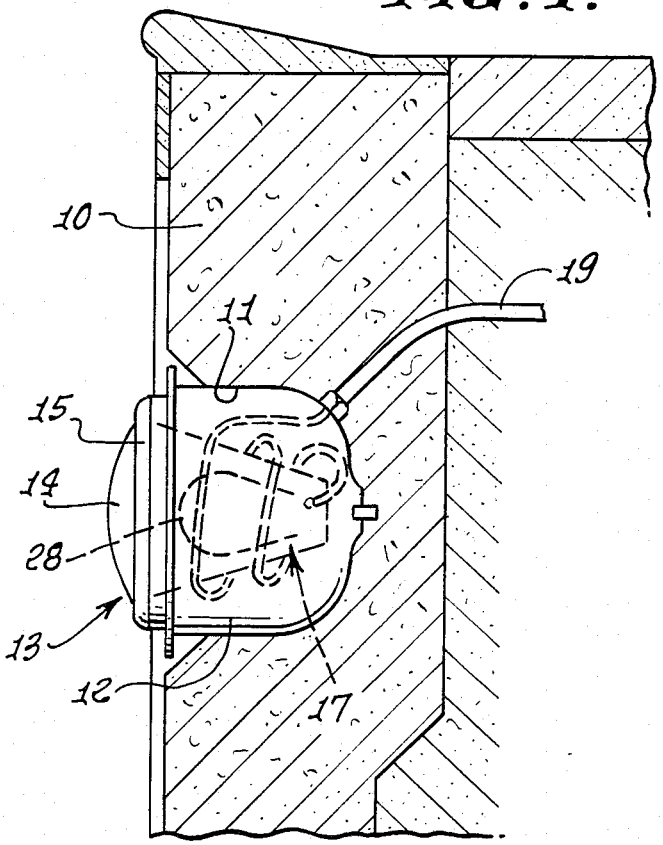
FIG. 1 is a side elevation, in section, showing a pool or spa wall niche receiving a shell containing a light assembly.

Referring first to FIG. 1, a pool or spa wall 10 (typically concrete) forms a niche 11 that receives a metallic shell 12. The latter receives an underwater light assembly generally indicated at 13, and including an underwater lens 14, face ring 15 supporting the lens, and attached to the shell, lens gasket 16 carried by the face ring, and light housing 17 carried by the face ring. A light bulb 18 is carried in the conical housing 17, and electrical wiring to the bulb appears generally at 19. See also U.S. Pat. Nos. 4,234,819 and 4,460,944.

Referring now to FIGS. 2–6, the light assembly face ring 15 comprises a thin metallic annulus defining a central axis 20. The ring has a front wall 21 which extends in a plane normal to axis 20; and outer cylindrical wall 22; and a wall 23 extending from the radially inner portion of wall 21 re-entrantly into the space 24 rearwardly of wall 21 and inwardly of wall 22. Re-entrant wall 23 defines an annularly and rearwardly flared portion **23*a* to seat gasket 16 annularly and axially. See the elastomer gasket U-shaped cross section in FIG. 4, with forward lip 16*a* annularly and pressurally seated and sealing against flared wall portion 23*a***.

Ring 15 also has circularly spaced tabs 26 thereon and projecting generally axially rearwardly beyond the edge **23*b* of the flared wall portion 23*a* to peripherally position the gasket, and blocking radially outward extrusion thereof when compressed axially by light housing 17. In this regard, note the housing annular flange 17*a* pressed forwardly against the gasket head 16*b*, causing outward extrusion or pressing of the gasket wall 16*c* against the inner sides of the tabs 26. At the same time, the outer flange 14*a* of the transparent (glass or plastic) lens 14 is squeezed between gasket lips 16*a* and 16*d*, to seal off therebetween. The tabs, being circularly spaced, allow limited gasket bulging in the spaces between the tabs, to accomodate the gasket to the adjacent structure, for development of substantially uniform sealing pressure at flanges 17*a* and 14*a*. The spaces between the tabs are typically between $\frac{3}{4}$ and 2 inches in length and the tab circular widths are between 3/16 and $\frac{1}{2}$ inch for a face ring having an outer diameter between 8 and 12 inches. Also, the use of the tabs allows maintenance of circularity at the flared wall portion 23*a***, for uniform sealing support of the annular gasket.

Housing 17 has a conical wall **17*b* which tapers rearwardly, and encloses an electrical light bulb indicated at 28, in FIG. 1**.

Means is provided on the face ring for connecting the ring to the light housing, so as to urge the flange **17*a* toward and against the gasket, as described, and with uniform pressure, exerted annularly. Such means is shown to include a circularly spaced series of studs 30 attached as by welding 31 to the face ring front wall. The studs project rearwardly in space 24, and at locations radially outwardly of a circle defined by the tabs. Fasteners 32 have heads 32*a* engaging the flange 17*a*, and threaded stem 32*b*** received by the studs, in threaded engagement therewith. Tightening of the fasteners effect the pressurization of the gasket, as described.

Figure 3:
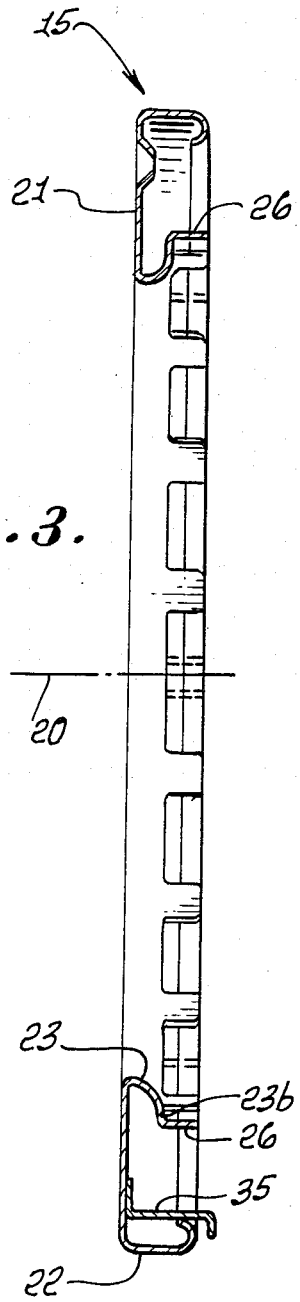
FIG. 3 is a vertical section on lines 3—3 of FIG. 2.
Figure 4:
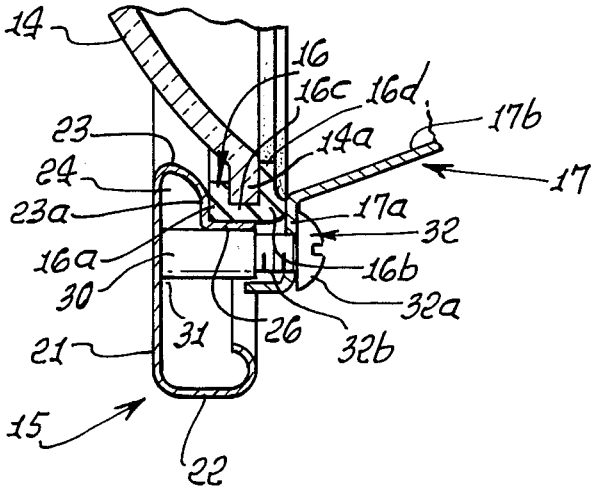
FIG. 4 is a fragmentary section showing assembly of the face ring to a lens, lens gasket and light housing.
Figure 6:
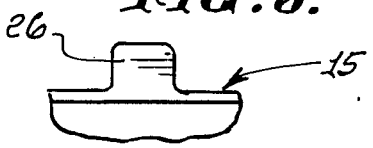
FIG. 6 is a section on lines 6—6 of FIG. 5.
Figure 2:
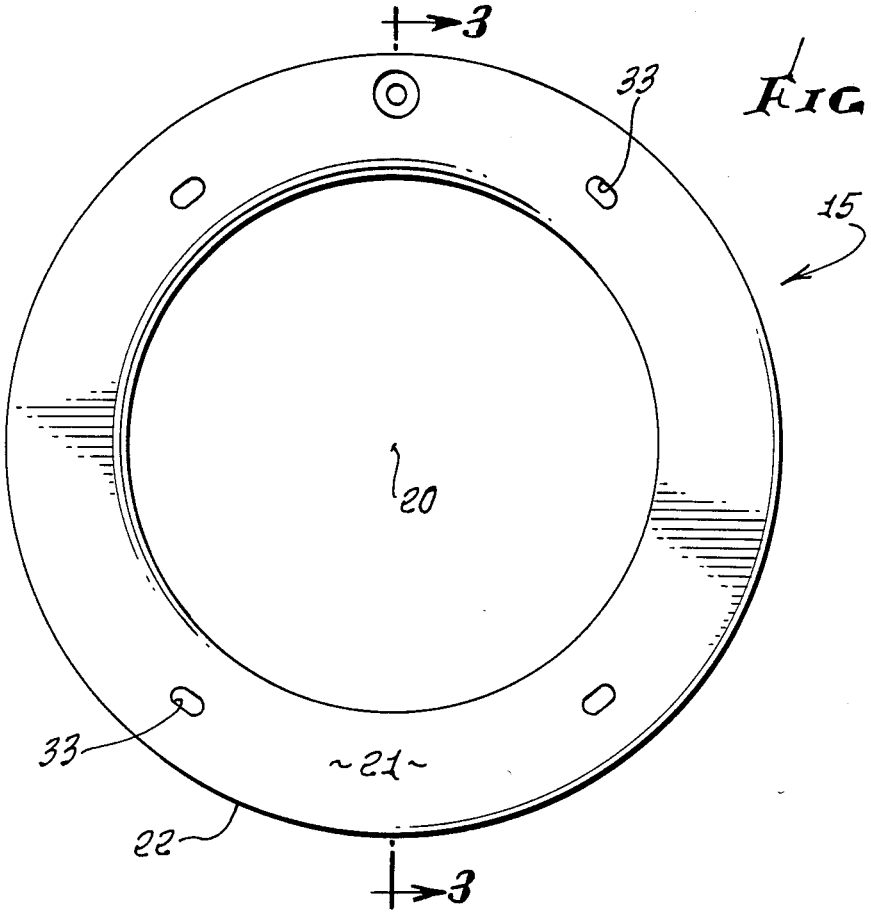
FIG. 2 is a front elevation showing a light assembly face ring.
Figure 5:
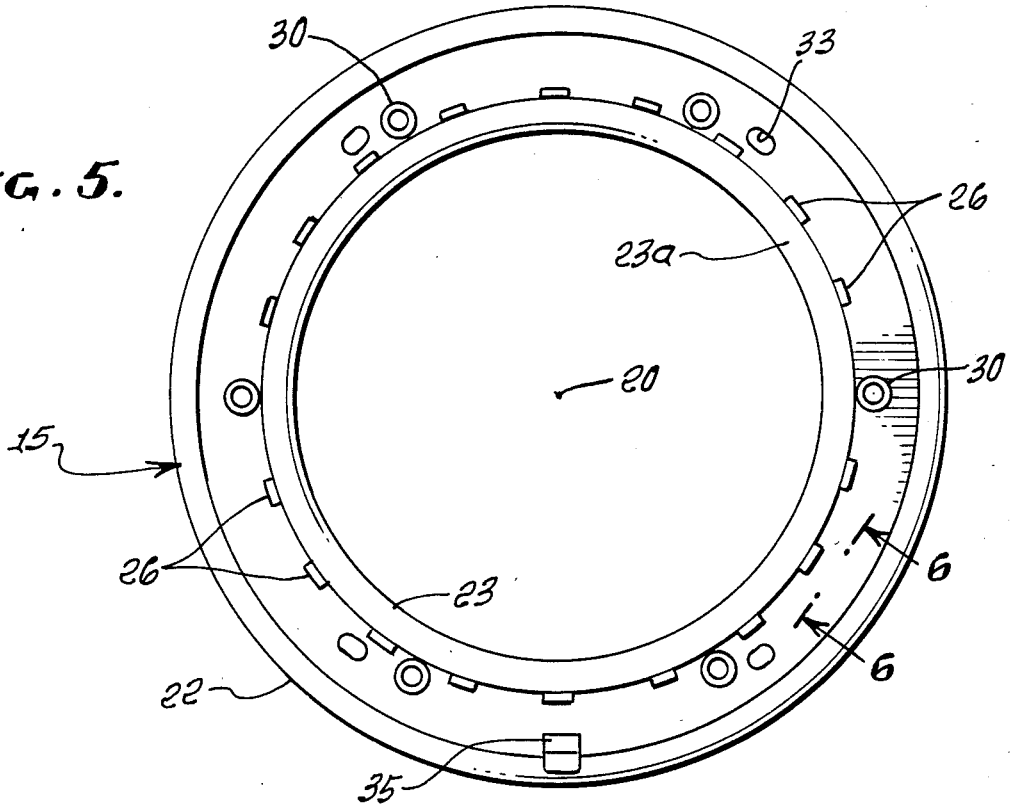
FIG. 5 is a rear elevation view of the FIG. 2 face ring.

Water circulation openings 33 are formed in wall 21, and pass pool or spa water to the space outside the housing conical wall 17*b*, for cooling same. FIG. 3 also shows a Z-shaped bracket 35 attached to the face ring, for attaching the ring to the shell 12.

I claim:

1. In an underwater pool or spa light assembly for retaining an annular lens gasket and light housing in position, the combination comprising (a) a face ring having a central axis and annular re-entrant wall defining an annular flared wall portion to seat the gasket assembly, the ring also having means thereon to retain said light housing which is engagable with the gasket to annularly compress same, axially, (b) and circularly spaced apart tabs on the ring, each tab having substantially constant circular width and projecting generally axially beyond the edge of said annularly flared portion to peripherally position the gasket, the said tabs blocking radially outward extrusion thereof when compressed by said housing, while allowing gasket bulging between the tabs, (c) and including said gasket with its periphery positioned radially adjacent said tabs, and the gasket axially compressed between said flared portion and an annular flange defined by said housing, to seal off therebetween, the tabs projecting toward said flange and spaced therefrom, said tabs being carried by said re-entrant wall annular flared portion having a rim, the tabs projecting generally axially from said rim.

2. The combination of claim 1 wherein said tabs and ring define a one-piece metallic unit, the tab circular widths being between 3/16 and $\frac{1}{2}$ inch, and the spaces between the tabs between $\frac{3}{4}$ and 2 inches in length.

3. The combination of claim 1 including means on the face ring for connecting the ring to said light housing to urge said flange defined by said housing toward the gasket.

4. The combination of claim 1 including a shell adapted for reception in a pool or spa wall niche, and receiving said face ring, said gasket and said light housing.

5. The combination of claim 4 including a lens having an annular peripheral portion confined by said gasket which has a U-shaped cross section, radially inwardly of said tabs.

6. The combination of claim 1 wherein said means includes circularly spaced studs attached to the face ring, to attach to fasteners carried by said flange, at locations immediately radially outwardly of a circle defined by said tabs.

7. The combination of claim 3 including said fasteners having heads engaging the light housing flange, and threaded stems received by said studs, to develop pressure exerted on the gasket.

8. The combination of claim 6 including water circulation through openings in a wall defined by said face ring, said studs attached to said wall.

* * * * *